US011192618B2

(12) United States Patent
Brisard

(10) Patent No.: US 11,192,618 B2
(45) Date of Patent: Dec. 7, 2021

(54) SURFACE-ASSISTED UNDERWATER EXPLORATION APPARATUS

(71) Applicant: Jean Ronald Brisard, Englewood, NJ (US)

(72) Inventor: Jean Ronald Brisard, Englewood, NJ (US)

( * ) Notice: Subject to any disclaimer, the term of this patent is extended or adjusted under 35 U.S.C. 154(b) by 72 days.

(21) Appl. No.: 16/729,602

(22) Filed: Dec. 30, 2019

(65) Prior Publication Data

US 2021/0197938 A1 Jul. 1, 2021

(51) Int. Cl.
*B63C 11/20* (2006.01)
*B63C 11/46* (2006.01)
*B63C 11/02* (2006.01)

(52) U.S. Cl.
CPC ..... *B63C 11/20* (2013.01); *B63C 11/46* (2013.01); *B63C 2011/025* (2013.01)

(58) Field of Classification Search
CPC ..... B63B 32/10; B63B 32/20; B63C 11/46; B63C 2011/025; B63C 11/20
See application file for complete search history.

(56) References Cited

U.S. PATENT DOCUMENTS 2,776,443 A * 1/1957 Howard ..... B63B 34/63 440/87
3,358,635 A * 12/1967 McRee ..... B63B 34/63 440/87
4,602,589 A * 7/1986 Quinata ..... A63B 35/12 114/242
5,323,727 A * 6/1994 Heaton ..... A63B 35/12 114/242
5,379,714 A * 1/1995 Lewis ..... B63C 11/46 114/315
2009/0000617 A1* 1/2009 Rosenberger ..... B63C 11/46 128/201.27
2017/0349253 A1* 12/2017 Santa Catarina ..... B63B 1/10
2021/0031578 A1* 2/2021 Camarena-Vazquez ..... B63C 11/49

* cited by examiner

*Primary Examiner* — Andrew Polay

(57) ABSTRACT

Systems and methods to allow a user to be both towed by and control a personal flotation craft from behind and underneath while engaging in underwater exploration comprising one or more propulsion devices, an optionally foldable tow shaft and one or more directional controllers. Wherein the systems and methods may further comprises one or more remotely controllable speed modulators, controlled by a user from behind and underneath the personal flotation craft, while engaging in underwater exploration.

20 Claims, 4 Drawing Sheets

SURFACE-ASSISTED UNDERWATER EXPLORATION APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD

The present application relates to underwater exploration and specifically to vehicles that assist by providing propulsion during the exploration.

BACKGROUND

In underwater explorations the type of diving dictates the kind of equipment need. One popular type of underwater exploration is referred to as SCUBA, which is an acronym for Self-Contained Underwater Breathing Apparatus. In this type of underwater exploration, the diver typically carries tanks of compressed air with a mouth-piece/regulator for autonomous breathing. This allows the diver to move around freely and explore large undersea area.

Another type of underwater exploration is called snorkeling, whereby a swimmer wears a facemask with a short snorkel tube that extends above the water for breathing (on the surface). In snorkeling, the swimmer's exploration activities are mainly done while swimming on the surface of the water. As such, the snorkeler's head is immersed in the water for viewing underwater scenery through the facemask, while breathing through a breathing tube, called a snorkel, that extends above the water. While most snorkeling is done near the surface, a trained snorkeler can make short excursions underwater, while holding his/her breath, and then expelling any water that might have entered the snorkel upon returning to the surface.

Snorkeling and scuba diving are both strenuous physical activity that can leave the underwater explorer exhausted. Often, an underwater explorer is brought to an area to be explored by a water craft/boat and then the explorer begins their exploration from that craft. As a result, there are two significant safety issues that can arise: 1) the explorer forgets in the excitement of the underwater exploration to stay near the craft (and because of the physical exhaustion can put themselves in danger) and 2) the explorer might stay in one location but the craft (possibly pushed by the wind or currents) drifts away from the explorer. Either condition can be extremely dangerous. Additionally, due to the strenuous nature, the explorer is also somewhat limited to the size of the area that can be explored while in the water.

Therefore, there continues to be a need for a craft that reduces the physical burden of underwater exploration and significantly improves the safety of the activity by allowing the explorer and the craft to remain in close proximity to one another.

SUMMARY

In order to overcome the deficiencies in the prior art, systems and methods are described herein.

One aspect of the claimed invention involves systems and methods to allow a user to be both towed by and control a personal flotation craft from behind and underneath while engaging in underwater exploration comprising: one or more propulsion devices configured to provide sufficient power to tow the user engaging in underwater exploration from behind and below the personal flotation craft; at least one tow shaft configured to allow the user to be towed behind and underneath the personal flotation craft; and one or more directional controllers configured to allow the personal flotation craft to be steered from behind and below the personal flotation craft.

Another aspect involves systems and methods to further allow the speed of one of the one or more propulsion devices to remotely have its speed modulated by a user from behind and underneath the personal flotation craft while engaging in underwater exploration.

Still other aspects involve connecting a breathable air pathway between the personal flotation craft and a user wearable breathing apparatus.

These and other aspects described herein present in the claims result in features and/or can provide advantages over current technology.

The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages or features are mutually exclusive or contradictory, in that they cannot be simultaneously present in a single embodiment. Similarly, some advantages are applicable to one aspect of the invention, and inapplicable to others. Thus, the elaborated features and advantages should not be considered dispositive in determining equivalence. Additional features and advantages of the invention will become apparent in the following description, from the drawings, and from the claims.

DETAILED DESCRIPTION

The instant devices and approach provide a way to allow an underwater explorer to be both towed by and control a personal flotation craft from behind and underneath the craft while engaging in underwater exploration.

A personal flotation craft is surfboard, kayak, inner tube or other small craft meant for a user to ride upon, by at least partially lie, sit or stand on (or in), that can act as a means of transportation by the user when they are doing the same, either by the user propelling the craft through their own physical exertion (e.g. paddling, kicking, rowing) or through a supplemental means of propulsion e.g. a motor, sail, kite . . . etc.).

One or more propulsion devices configured to be supplied/attached to the personal flotation craft and when attached to provide sufficient power to tow the user engaging in underwater exploration behind and below the personal flotation craft.

At least one tow shaft having at least two ends, wherein one end is configured to be attached to the personal flotation craft and the other distal end extends behind and below the personal flotation craft. Attached to the distal end is one or more directional controllers configured to allow the personal flotation craft to be steered from behind and below the personal flotation craft.

Figure 1A:
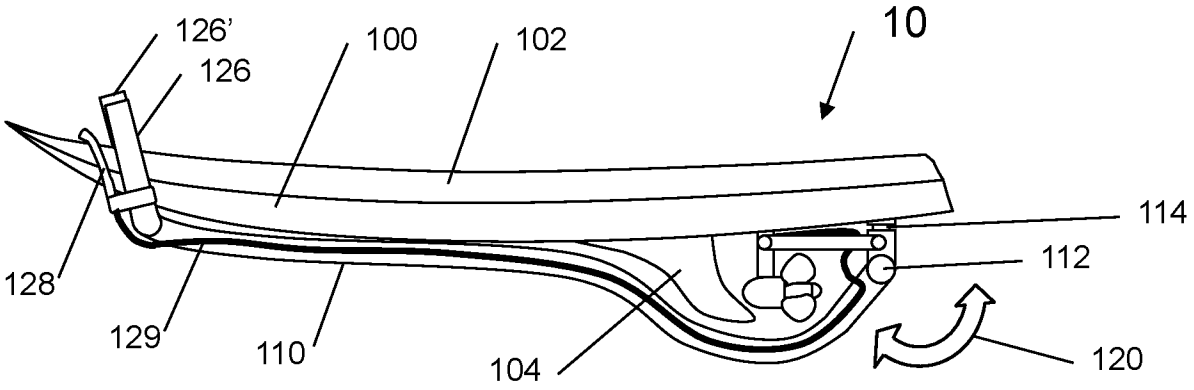
FIG. 1A-B show, in simplified form, a representative personal flotation craft.
Figure 1B:
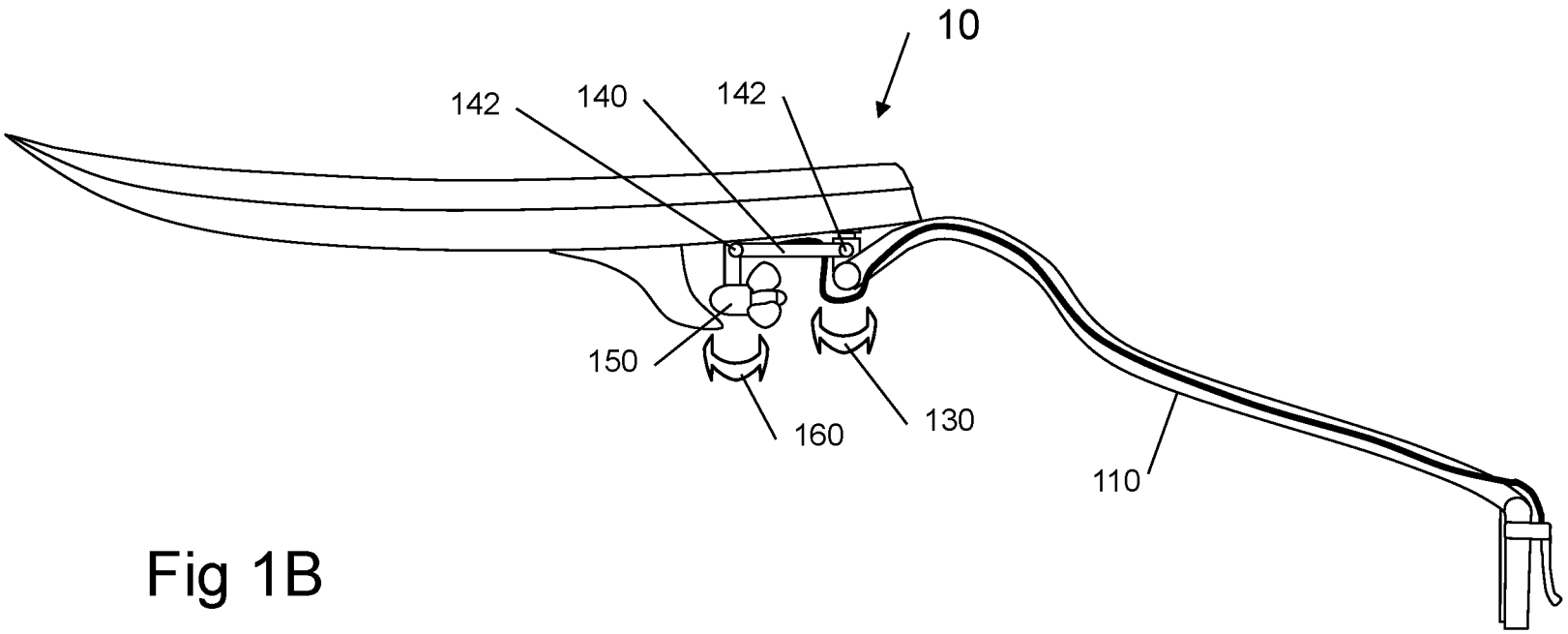

FIG. 1A-B show, in simplified form, a representative personal flotation craft.

Specifically, in FIG. 1A-1B we see a representative personal flotation craft 10, in this particular case represented as a surfboard 100. The surfboard is represented as having a deck 102 that a user can lie, sit, or stand on. The surfboard 100 also has zero or more fins 104. Fins 104 are useful to prevent lateral drift and help stabilize the board's trajectory.

The personal flotation craft 10 has a tow arm 110 that, in this particular example, is represented as a foldable tow arm that folds 120 about an axis 112 and has at least two positions: open (see FIG. 1B) and closed (see FIG. 1A).

The tow arm 110 has two ends: a proximal end, where it is attached to the surfboard 100, and a distal end, used for steering by the user. In this particular case, the attachment to the surfboard is represented as including a pivot point 114 that allows the tow arm 110 to rotate 130 and, through a mechanical linkage 140, causes the propulsion device 150 (represented as a motor with a propeller) to also rotate 160, whereby the personal flotation craft 10 can be steered.

At the distal end, tow arm 110 is represented as split handlebars 126, 126', which are represented as similar to handlebars fora bicycle. As such, in the closed position the handlebars 126, 126' are represented as spanning the surfboard 100. In the open position, rotating 130 the handlebars 126, 126' steers the personal flotation craft 10 from behind and underneath the craft 10.

At the distal end, the tow arm 110 is further represented as having one or more speed controllers 128, configured to remotely modulate the speed of the propulsion device 150 and is represented as connected to the propulsion device 150 through a cable 129.

Figure 2A:
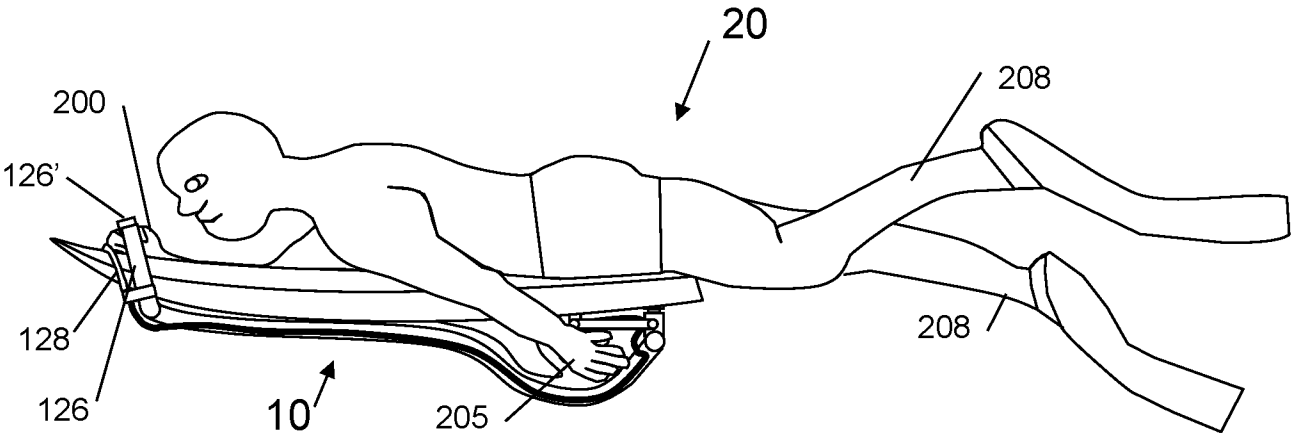
FIG. 2A-B show, in simplified form, a user riding on and an underwater explorer being towed behind a representative personal flotation craft.
Figure 2B:
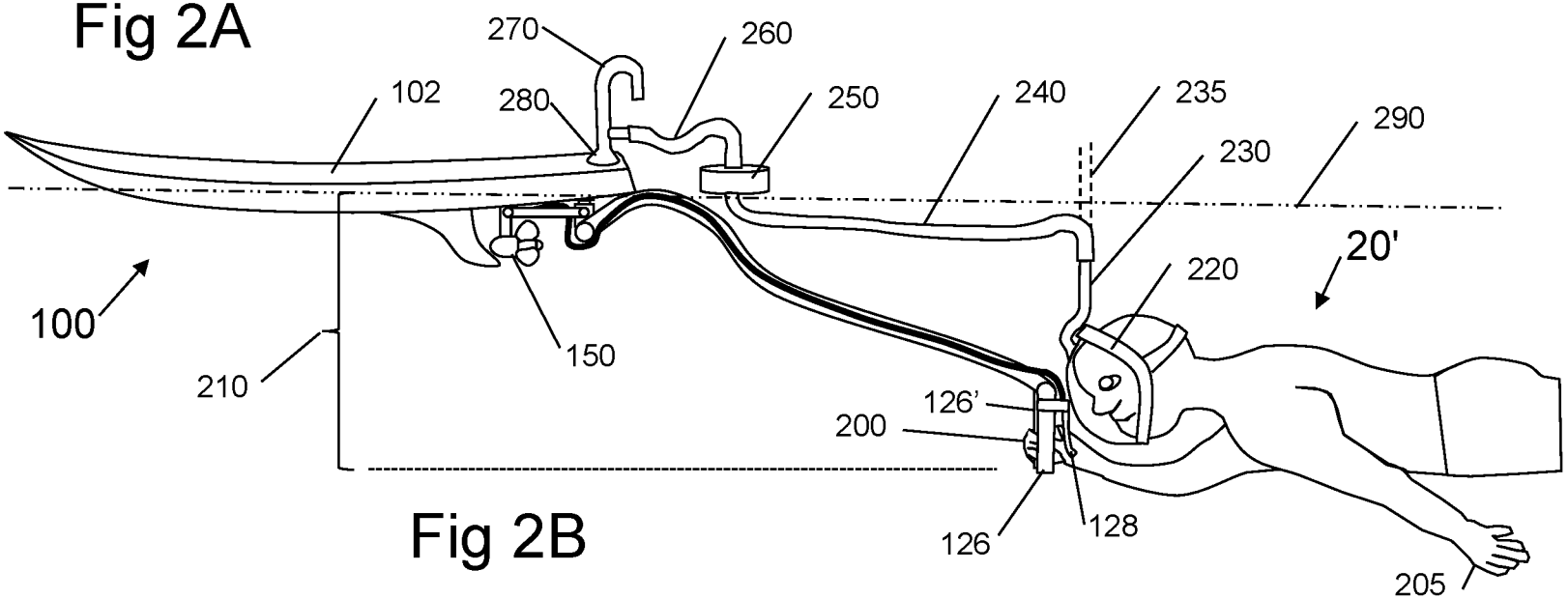

Before describing the function of the personal flotation craft 10 in more detail, it is useful to see how a user would use the craft, which can be seen in FIG. 2A-B. FIG. 2A-B show, in simplified form, a user 20 riding on and an underwater explorer 20' being towed behind a representative personal flotation craft 10.

In FIG. 2A, the user 20 is represented as lying on the personal flotation craft 10. The user's right hand 200 is represented as holding onto the handlebar 126' on the right side of the personal flotation craft 10. The user's left hand 205 is being used to paddle, in order to provide manual propulsion of the craft 10. Additionally, the user 20 is represented as potentially further providing propulsion by kicking with his legs 208. Alternatively, or in addition to manual propulsion, the user 20 could place his left hand on the handlebar 126, on the left side of the personal flotation craft 10, and engage the speed controller 128, whereby the propulsion device 150 could be used for propulsion.

Alternatively, if the speed controller 128 were turned around to face the user 20 then it would be clear that the user 20 could just as easily have been sitting on the craft 10 and engaged the speed controller 128, with his foot, much like a gas pedal. Other means of propulsion include but are not limited to rowing (either seated or standing), sails and/or kites. The importance being that the personal flotation craft 10 can act as a form of transportation for the user 20, while the user 20 is at least partially lying, sitting or standing on the craft 10.

In FIG. 2B, we observe that the user 20 has transformed into an underwater explorer 20' and is being towed behind and underneath the personal flotation craft 10, where underneath is defined as below the surface of the portion of the personal flotation craft 10 that is above the water level 290, represented by the dashed line with two dots. The depth 210 to the underwater explorer 20' should typically not exceed 2-3 feet for snorkeling (represented in FIG. 2B), unless pressurized air is supplied in the form of an auxiliary tank (scuba tank) or compressor. This is due to the fact that, beyond this depth, the surrounding water pressure makes it too hard to draw air into your lungs.

The underwater explorer 20' is represented as wearing a breathing apparatus. In this particular case, the underwater explorer 20' is represented as wearing a full face snorkel mask 220 with integrated snorkel 230, the snorkel could go directly above the water level 290; however, in this particular case, it is represented as connected through a breathable air pathway 240, 250, 260, 270 that is attached to the personal flotation craft 10, represented as suction cupped 280 to the deck 102. The breathable air pathway could have been a single tube; however, the preferred implementation is to have an inverted tube 270 (to prevent rain water from entering) and incorporates a float 250, as well as several interconnections 240, 260, to help keep the breathable air pathway from getting caught in the propulsion device 150. The importance being that there is a breathable air pathway that provided either ambient or pressurized air depending on the desired depth of underwater exploration.

Having described the general operation with respect to FIG. 1A-2B, we want to return to FIG. 1A-1B, to describe the system and its operation in more detail.

In FIG. 1A-B the tow arm 110 is represented as a foldable. However, a permanently attached or removably attached are also anticipated. The importance being that the tow arm is configured to allow an underwater explorer 20' to provide directional control of the personal flotation craft 10 while being towed from behind and underneath the craft 10.

As previously stated, the tow arm 110 is represented as attached to the surfboard 100 and including a pivot point 114 that allows the tow arm 110 to rotate 130 and through a mechanical linkage 140, which in turn causes the propulsion device 150 (represented as a motor with a propeller) to also rotate 160, whereby the personal flotation craft 10 can be steered. The mechanical linkage 140 is represented as a bar connected externally between two rotating objects.

Mechanical linkages to transfer rotational motion from one object to another are well known in the art. Examples of mechanical linkages that could have been deployed include interconnected gears, gear and chain drives, belt and pulley, or simple mechanical connections. For completeness, a representative simple mechanical connection is shown in FIG. 3A-B.

Figures 3A, 3B:
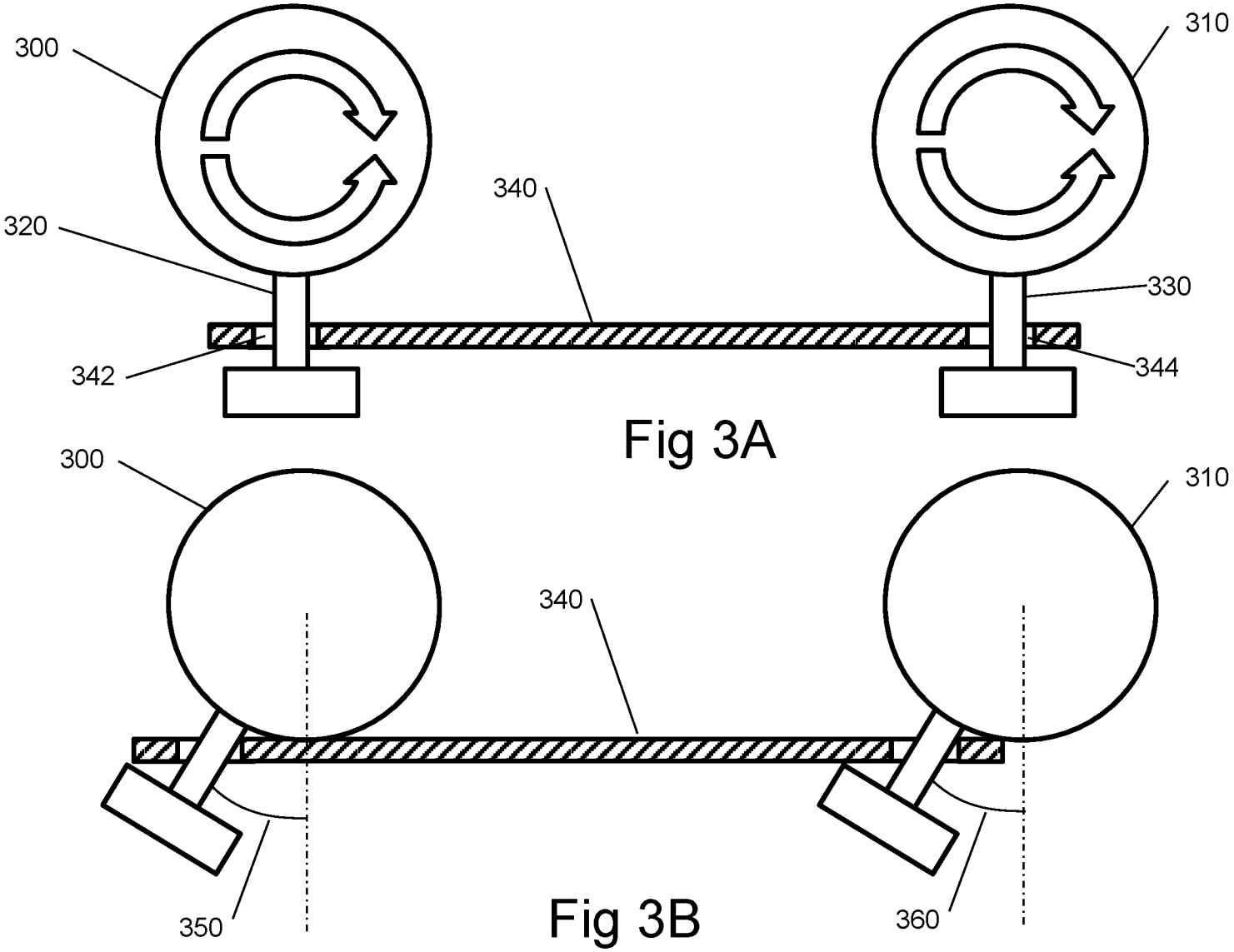
FIG. 3A-B show, in simplified form, a simple mechanical linkage to transfer rotational motion between two rotatable bodies.

FIG. 3A-B show, in simplified form, a simple mechanical linkage to transfer rotational motion between two rotatable bodies. In FIG. 3A, a first and second rotating bodies 300, 310 are represented as being connected together via a plate 340. The plate 340 is represented as being cross-sectioned in a plane running through the center of the two through holes 342, 344 in the plate 340. A rotational motion of the first rotating body 300 through a rotation angle 350 causes a rotation angle 360 in the second body 310. It is worth noting that the simple mechanical linkage represented in FIG. 3A-B is unlike a gear and chain drive in that the rotation angles 350, 360 of the simple mechanical linkage represented in FIG. 3A-B are typically limited to 45 degrees or less.

The tow arm 110 is represented as steering the personal flotation craft 10 by rotating 130 the tow arm 110, which causes a rotation 160 of the propulsion device 150. Alternatively, rather than causing a rotation of the propulsion device 150, the rotating of the tow arm 110 could equally have steered the personal flotation craft 10 by rotating one or more fins 104 or a combined propulsion device/fin. Additionally, the tow arm 110 need not necessarily steer the personal flotation craft 10 by rotating 130 at all. A fixed tow arm with a remote control, such as a joystick control, could be used to steer the personal flotation craft 10 from behind and underneath. Additionally, with a fixed tow arm (or after the tow arm has reached its mechanical limit (see FIG. 3B)), depending on the weight of the personal flotation craft 10 and the lateral stability (e.g. use and size of fins), an underwater explorer has the potential to manhandle a personal craft by rotating the entire personal flotation craft rather than rotating a portion of it (e.g. propulsion device or fins). In the case of the personal flotation craft 10 represented in FIG. 1A-B, this manhandling is specifically facilitated by the spilt handlebars 126, 126'. While the fin 104 potentially makes this particular personal flotation craft 10 harder to manhandle from behind and underneath the craft 10, this would not be the case of a personal flotation craft such as an inner tube, which would be easy to manhandle in order to steer an inner tube type personal flotation craft from behind and underneath such a craft.

Further, the tow arm 110 is represented as having a speed controller 128 that is represented as connected to the propulsion device 150 through a cable 129. The cable 129 is representative of a connection to the propulsion device in order to control its speed and could take the form of an electrical or mechanical connection but remote connections such as the previously mentioned remote control joystick. However, while speed control is highly desirable, being able to turn the propulsion device 150 off, after it has been turned on, is the minimum requirement.

Figure 4:
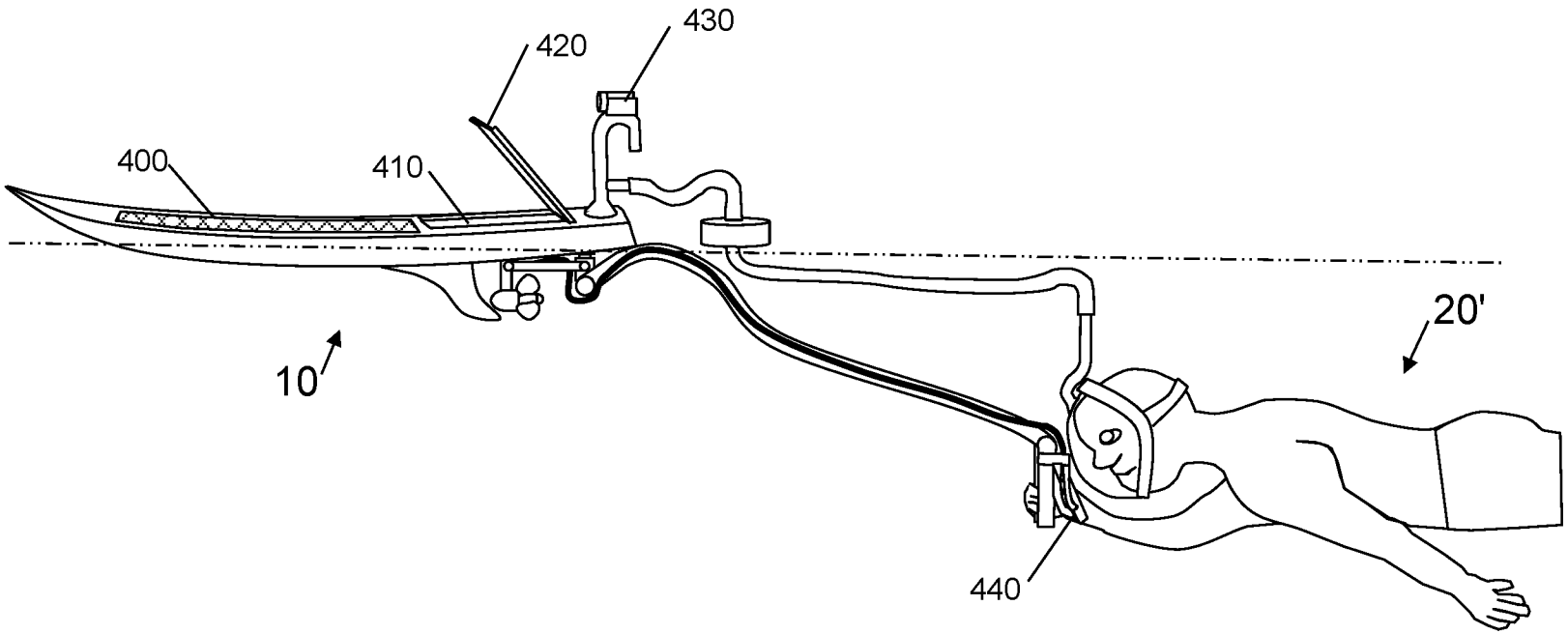
FIG. 4 shows, in simplified form, the personal flotation craft with additional features.

Additionally, we would now like to highlight a few useful features as show in FIG. 4. FIG. 4 shows, in simplified form, the personal flotation craft 10 with additional features. Specifically, in FIG. 4, we see the personal flotation craft 10 controlled by the underwater explorer 20' with one or more deck features 400, one or more storage compartments 410, one or more waterproof seals 420 for the one or more storage compartments 410, and one or more video cameras 430 that send video images of the surrounding area above the water level to at least one monitor 440 positioned to be viewable by the underwater explorer 20' (or, alternatively, one or more underwater video cameras to send video images of the surrounding area under the water to at least one monitor positioned to be viewable while riding on the personal flotation craft). The deck feature 400 could be solar energy collectors, used to supply power to the propulsion device (or be used for auxiliary power). Another possibility for the deck feature 400 would be a window running through the personal flotation craft 10 to allow underwater viewing.

Other features not shown, include buoyancy controls to allow water to enter into the personal flotation craft 10 in order to submerge the craft and a pressurized air supply to evacuate the water and make it float again.

Finally, it is to be understood that various different variants of the invention, including representative embodiments and extensions have been presented to assist in understanding the invention. It should be understood that such implementations are not to be considered limitations on either the invention or equivalents except to the extent they are expressly in the claims. It should therefore be understood that, for the convenience of the reader, the above description has only focused on a representative sample of all possible embodiments, a sample that teaches the principles of the invention. The description has not attempted to exhaustively enumerate all possible permutations, combinations or variations of the invention, since others will necessarily arise out of combining aspects of different variants described herein to form new variants, through the use of particular hardware or software, or through specific types of applications in which the invention can be used. That alternate embodiments may not have been presented for a specific portion of the description, or that further undescribed alternate or variant embodiments may be available for a portion of the invention, is not to be considered a disclaimer of those alternate or variant embodiments to the extent they also incorporate the minimum essential aspects of the invention, as claimed in the appended claims, or an equivalent thereof.

What is claimed:

1. A system configured to allow a user to be both towed by and control a personal flotation craft from behind and underneath while engaging in underwater exploration comprising:

one or more propulsion devices configured to be attached to the personal flotation craft and, when attached, to provide sufficient power to tow the user engaging in underwater exploration from behind and below the personal flotation craft;

at least one tow shaft having at least two ends, wherein one end is a proximal end and is configured to be attached to the personal flotation craft and the other distal end extends behind and below the personal flotation craft and is configured to allow the user to be towed behind and underneath the personal flotation craft;

wherein the proximal end comprises a pivot point configured to allow the tow arm to rotate and a mechanical linkage configured to causes the propulsion device to also rotate, whereby the personal flotation craft can be steered; and wherein, attached to the distal end is one or more directional controllers configured to allow the personal flotation craft to be steered from behind and below the personal flotation craft.

2. The system of claim 1 wherein the personal flotation craft is a surfboard.

3. The system of claim 1 wherein the tow shaft is foldable and having at least two positions open and closed and wherein in the open position the tow shaft is configured to allow the user to be towed behind and underneath the personal flotation craft.

4. The system of claim 1 wherein the directional controllers are handlebars.

5. The system of claim 4 wherein the tow shaft is foldable and having at least two positions open and closed and wherein in the open position the handlebars are configured to allow the user to be towed behind and underneath the personal flotation craft and in the closed position the handlebars are configured to be used by a user riding upon the personal flotation craft.

6. The system of claim 1 wherein at least one of the one or more propulsion devices is configured with the ability to modulate its speed and the distal end further comprises one or more speed controllers configured to remotely modulate the speed of the propulsion device.

7. The system of claim 6 wherein the modulation comprises the ability to at least turn the propulsion device on and off.

8. The system of claim 1 further comprising a breathable air pathway that is attached to the personal flotation craft and configured to be connectable to a user wearable breathing apparatus.

9. The system of claim 8 wherein the breathable air pathway further comprises a float configured to help keep the breathable air pathway from getting caught in the propulsion device.

10. The system of claim 8 wherein the breathable air pathway provides access to ambient air.

11. The system of claim 8 wherein the breathable air pathway further provides access to pressurized air.

12. The system of claim 1 further comprising solar panels configured to supply power to the propulsion device.

13. The system of claim 1 further comprising buoyancy controls to allow water to enter into the personal flotation craft in order to submerge the personal flotation craft and a pressurized air supply to evacuate the water and make personal flotation craft float again.

14. The system of claim 1 further comprising one or more video cameras and at least one monitor wherein the one or more video cameras send video images of the surrounding area above the water level to the at least one monitor positioned to be viewable during underwater exploration.

15. A method of adapting a personal flotation craft to allow a user to be towed by and steer the personal flotation craft while engaging in underwater exploration comprising:

supplying the personal flotation craft with one or more propulsion devices configured to be attached to the personal flotation craft and, when attached, to provide sufficient power to tow the user engaging in underwater exploration from behind and below the personal flotation craft and extending underneath and behind the personal flotation at least one tow shaft configured to allow the user to steer the craft while being towed behind and underneath the personal flotation craft.

16. The method of claim 15 wherein the extending is accomplished through unfolding.

17. The method of claim 15 wherein the steering is configured to occur when a rotation is transmitted through a mechanical linkage between the at least one tow shaft and the one or more propulsion devices.

18. The method of claim 15 further comprises connecting a breathable air pathway between the personal flotation craft and a user wearable breathing apparatus.

19. The method of claim 18 wherein the breathable air pathway comprises a float configured to help keep the breathable air pathway from getting caught in the propulsion device.

20. A system configured to allow a user to be both towed by and control a personal flotation craft from behind and underneath while engaging in underwater exploration comprising:

one or more propulsion devices configured to be attached to the personal flotation craft and, when attached, to provide sufficient power to tow the user engaging in underwater exploration from behind and below the personal flotation craft;

at least one tow shaft having at least two ends, wherein one end is a proximal end and is configured to be attached to the personal flotation craft and the other distal end extends behind and below the personal flotation craft and is configured to allow the user to be towed behind and underneath the personal flotation craft;

wherein, attached to the distal end is one or more directional controllers configured to allow the personal flotation craft to be steered from behind and below the personal flotation craft;

wherein the directional controllers are handlebars; and wherein the tow shaft is foldable and having at least two positions open and closed and wherein in the open position the handlebars are configured to allow the user to be towed behind and underneath the personal flotation craft and in the closed position the handlebars are configured to be used by a user riding upon the personal flotation craft.

* * * * *